US010410547B2

(12) United States Patent
Kopelke et al.

(10) Patent No.: US 10,410,547 B2
(45) Date of Patent: Sep. 10, 2019

(54) PLACARD FASTENER

(71) Applicant: J. J. Keller & Associates, Inc., Neenah, WI (US)

(72) Inventors: Pamela Ann Kopelke, Greenville, WI (US); Kevin Roger Kucksdorf, Greenville, WI (US); Peter Bettinson, Burlington (CA)

(73) Assignee: J. J. KELLER & ASSOCIATES, INC., Neenah, WI (US)

( * ) Notice: Subject to any disclaimer, the term of this patent is extended or adjusted under 35 U.S.C. 154(b) by 0 days.

(21) Appl. No.: 15/633,089

(22) Filed: Jun. 26, 2017

(65) Prior Publication Data

US 2018/0374397 A1 Dec. 27, 2018

(51) Int. Cl.

| | |
|---|---|
| ***G09F 7/18*** | (2006.01) |
| ***G09F 7/08*** | (2006.01) |
| ***G09F 21/04*** | (2006.01) |

(52) U.S. Cl.

CPC ..... *G09F 7/18* (2013.01); *G09F 7/08* (2013.01); *G09F 21/04* (2013.01); *G09F 2007/1865* (2013.01)

(58) Field of Classification Search

CPC ..... G09F 7/00; G09F 7/18; G09F 2007/1843; G09F 2007/1847; G09F 2007/1856; G09F 2007/1865; Y10S 292/63; Y10S 292/11; Y10T 24/206; Y10T 24/44017

USPC ... 40/611.11, 590, 544, 588, 611.01, 611.02, 40/611.04, 611.06, 611.09, 611.1, 662, 40/663, 642.02, 643; 248/447.1, 447.2, 248/451, 452, 459, 468, 488, 489, 490, 248/495, 496; 292/1, 194, 195, 120

See application file for complete search history.

(56) References Cited

U.S. PATENT DOCUMENTS 591,905 A * 10/1897 White ..... A47B 23/042 248/451
747,188 A * 12/1903 Klee ..... A47B 23/042 24/DIG. 8
883,433 A * 3/1908 Utz ..... A47B 23/042 24/DIG. 8

(Continued)

FOREIGN PATENT DOCUMENTS

EP 2876629 5/2015

OTHER PUBLICATIONS

U.S. Appl. No. 15/633,068 dated Jun. 1, 2018 (6 pages).

*Primary Examiner* — Terrell L McKinnon
*Assistant Examiner* — Michael McDuffie
(74) *Attorney, Agent, or Firm* — Michael Best & Friedrich LLP

(57) ABSTRACT

A placard system for use in the transportation industry. The placard system includes a holder including a cavity and a placard fastener mounting hole. The cavity is configured to receive a placard. The placard fastener mounting hole is spaced from an opening of the cavity and defining an axis of rotation. The placard system further includes a placard fastener engaged with the holder and swingable about the axis of rotation between a closed position in which the placard fastener blocks a portion of the opening of the cavity and an open position in which the placard fastener is spaced from the opening of the cavity. The placard fastener includes a planar base portion including a mounting hole, an engagement portion configured to engage the holder or the placard, and an actuation portion.

19 Claims, 5 Drawing Sheets

(56) References Cited

U.S. PATENT DOCUMENTS 947,026 A * 1/1910 Peterson ..... G09F 3/18 40/653
1,006,270 A * 10/1911 Planert ..... B42F 9/001 24/67.7
1,038,280 A * 9/1912 Burnett ..... A47B 23/042 248/451
1,727,336 A 9/1929 Cooper
2,528,990 A * 11/1950 Atwood ..... B41J 29/15 248/451
3,455,044 A 7/1969 Falconbridge
3,481,060 A 12/1969 Hartz
3,518,782 A 7/1970 Long
3,544,056 A * 12/1970 Berquist ..... A47B 23/004 248/231.51
3,809,352 A * 5/1974 Mathias ..... A47B 23/042 248/444.1
4,058,918 A 11/1977 Fund
4,094,083 A 6/1978 Fund
4,106,229 A 8/1978 Schmid
4,178,710 A 12/1979 Schmid
4,229,891 A * 10/1980 Keller ..... G09F 7/00 40/590
4,436,271 A * 3/1984 Manso ..... A47B 19/00 248/452
4,702,453 A * 10/1987 Bishop ..... A47B 23/06 248/447.2
4,715,138 A 12/1987 Cherico
4,775,128 A * 10/1988 Evenson ..... A47B 23/043 248/448
4,999,938 A 3/1991 Behling
5,375,806 A * 12/1994 Debus ..... A47B 23/042 248/444.1
D359,253 S 6/1995 Luttrull et al.
5,797,578 A * 8/1998 Graffeo ..... A47B 23/043 248/453
6,237,887 B1 * 5/2001 Banner ..... A47B 23/004 248/459
6,590,148 B1 * 7/2003 Medina ..... B42D 9/04 84/486
6,665,967 B1 12/2003 Quackenbush
6,688,028 B2 2/2004 Backe
6,785,993 B1 9/2004 Lea
7,083,155 B1 * 8/2006 Smartt ..... A47B 19/10 248/441.1
7,540,464 B2 * 6/2009 Samari ..... A47B 23/04 248/346.07
7,707,759 B2 5/2010 Roberts
8,910,403 B2 12/2014 Nimtz
2010/0077641 A1 4/2010 Greenwald
2012/0091307 A1 * 4/2012 Haynes ..... A47B 23/043 248/451

* cited by examiner

PLACARD FASTENER

BACKGROUND

The present invention relates to a placard fastener for use with a transportation placard holder.

SUMMARY

Transportation vehicles, such as trucks, trains, or container ships that carry hazardous materials, must be placarded in accordance with 49 C.F.R. § 172. The placards must be positioned on exposed sides (e.g. front and back ends and both sides) of the transportation container, for example, a trailer of a truck, a railcar, a storage tank, or an intermodal container. The placards identify the hazardous material carried in the transportation vehicle and provide information related to the hazard posed by the identified hazardous material and give cleanup instructions in the event of a spill or incident. The placards must be removed whenever the transportation vehicle is carrying a non-hazardous cargo or must be changed to correspond to the identity of a new hazardous cargo. The placards are received in placard holders positioned on the ends and sides of the transportation container and are secured to the placard holder using placard fasteners.

Since the placards are frequently changed and since the transportation container is exposed to harsh outdoor environmental conditions, the placard fasteners experience wear and eventually fail. A broken placard fastener may cause "placard blowout," in which the placard blows out of the placard holder. Placard failures, therefore, can cause non-compliance with 49 C.F.R. § 172, safety problems, or mishandling of hazardous materials in the event of a spill or other incident. Prior art placard fasteners consist of a snap fastener which is riveted to the placard holder. The snap fastener flips down to secure the placard into the placard holder and flips up to release. The snap fasteners are difficult to open and often times the end-user uses a broom handle or some other tool to open the fastener. The pressure on the fastener when flipping them open or closed causes breakage or premature wear.

In one construction, the disclosure provides a placard system for a transportation container or vehicle. The placard system includes a holder including a cavity and a placard fastener mounting hole. The cavity is configured to receive a placard. The placard fastener mounting hole is spaced from an opening of the cavity and defining an axis of rotation. The placard system further includes a placard fastener engaged with the holder and rotatable about the axis of rotation between a closed position in which the placard fastener blocks a portion of the opening of the cavity and an open position in which the placard fastener is spaced from the opening of the cavity. The placard fastener includes a planar base portion including a mounting hole, an engagement portion configured to engage the holder or the placard, and an actuation portion.

In another construction, the disclosure provides a method of securing a placard within a placard holder for transportation. The method includes grasping an actuation portion of a placard fastener engaged with the placard holder. The placard fastener includes a planar base portion having a mounting hole defining an axis of rotation and an engagement portion configured to engage a lip of the placard holder. The method further includes swinging the placard fastener about the axis of rotation so that the placard fastener is spaced from an opening of a cavity of the placard holder.

The method further includes positioning a placard within the cavity of the placard holder. The method further includes swinging the placard fastener about the axis of rotation so that the placard fastener is blocking a portion of the opening of the cavity.

In another construction, the disclosure provides a placard system for a transportation container for use with a transportation vehicle. The placard system includes a holder including a cavity and a raised ridge. The cavity is configured to receive a placard and a raised ridge. The cavity is formed between a first holder portion and a second holder portion. The raised ridge is formed on the first holder portion and spaced from an opening of the cavity. A placard fastener mounting hole spaced is spaced the raised ridge and defines an axis of rotation. The placard system further includes a placard fastener engaged with the holder and rotatable about the axis of rotation between a closed position in which the placard fastener is engaged with the raised ridge and blocks a portion of the opening of the cavity, and an open position in which the placard fastener is spaced from the opening of the cavity. The placard fastener includes a planar base portion having a mounting hole. The placard fastener further includes a securing portion positioned between the planar base and the engagement portion. The securing portion is adapted to engage the raised ridge. The placard fastener further includes an engagement portion including a vinyl rivet that engages the placard or the placard holder configured to engage the holder or the placard, and an actuation portion including a first tab and a second tab.

Other aspects of the disclosure will become apparent by consideration of the detailed description and accompanying drawings.

DETAILED DESCRIPTION

Before any constructions are explained in detail, it is to be understood that the disclosure is not limited in its application to the details of construction and the arrangement of components set forth in the following description or illustrated in the following drawings. The invention is capable of other constructions and of being practiced or of being carried out in various ways.

In any disclosed construction, the terms "substantially" or "approximately" may be substituted with "within a percentage of" what is specified, where the percentage includes 0.1, 1, 5, and 10 percent. The terms "angled", "angle", and "slanted" are used to mean a non-zero angle or a non-parallel relationship between two components.

Figure 1:
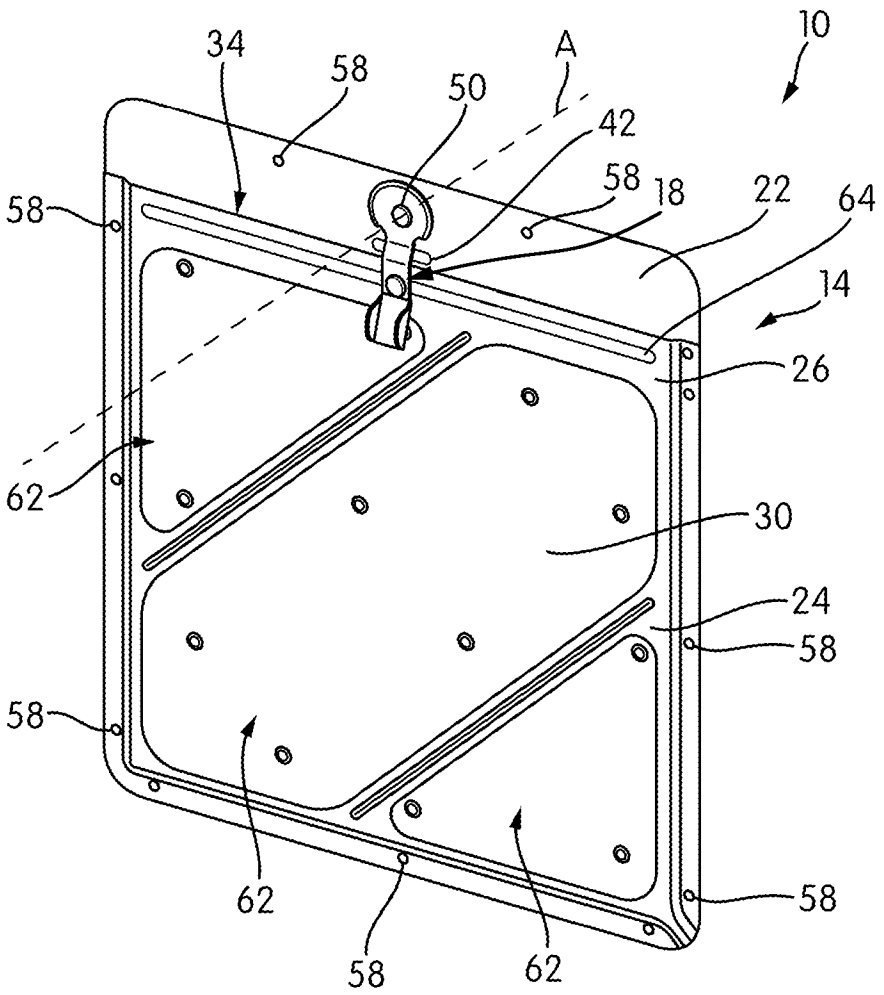
FIG. 1 is a perspective view of a placard holder with placard fastener according to one construction.

FIG. 1 illustrates a placard system 10 including a placard (not shown), a placard holder 14 and a placard fastener 18. The placard system 10 is secured to a transportation container (not shown), such as a truck, a railcar, an intermodal container, or a storage tank. The placard system 10 may be secured to the transportation container by fasteners such as rivets or bolts or by an adhesive affixed to a rear surface (not shown) of the placard holder 14.

The placard (not shown) has a front side and a back side (not shown). The front side of the placard includes information about an identity of a hazardous material stored in the transportation container. For example, the front side of the placard may include indicia indicative of the specific identity of the hazardous material or a particular hazard warning about the particular danger posed by the hazardous material (e.g. "flammable" or "corrosive", or visuals symbols indicating the same). A placard for use with the illustrated placard holder 14 would be a substantially square shaped placard.

In the construction illustrated in FIG. 1, the placard holder 14 includes a first holder portion 22 and a second holder portion 26. The first holder portion 22 and the second holder portion 26 cooperatively form a cavity 30. The cavity 30 includes an opening 34 for receiving the placard. The first holder portion 22 can be substantially square-shaped and planar. The first holder portion 22 includes a fastener mounting hole 38 (FIGS. 4-5), a ridge 42, and plurality of mounting holes 58. The fastener mounting hole 38 is positioned proximate the opening 34 of the cavity 30 and spaced from the opening 34. The fastener mounting hole 38 is sized to receive a fastener 50 for securing the placard fastener 18 to the placard holder 14. The fastener mounting hole 38 defines an axis of rotation A the placard fastener 18. The ridge 42 is positioned on the first holder portion 22 between the opening 34 and the fastener mounting hole 38. The plurality of mounting holes 58 sized to receive a plurality of fasteners (not shown) to secure the placard holder 14 to the transportation container (not shown).

The second holder portion 26 is secured to the first holder portion 22, for example, by staking or rivets. The second holder portion 26 includes a plurality of viewing apertures 62. The viewing apertures 62 allow visualization of a placard positioned within the cavity 30. A lip 64 is formed on the second holder portion 26 proximate the opening 34 of the cavity 30. The placard holder 14 may be formed differently in other constructions of the placard system 10.

Figure 2:
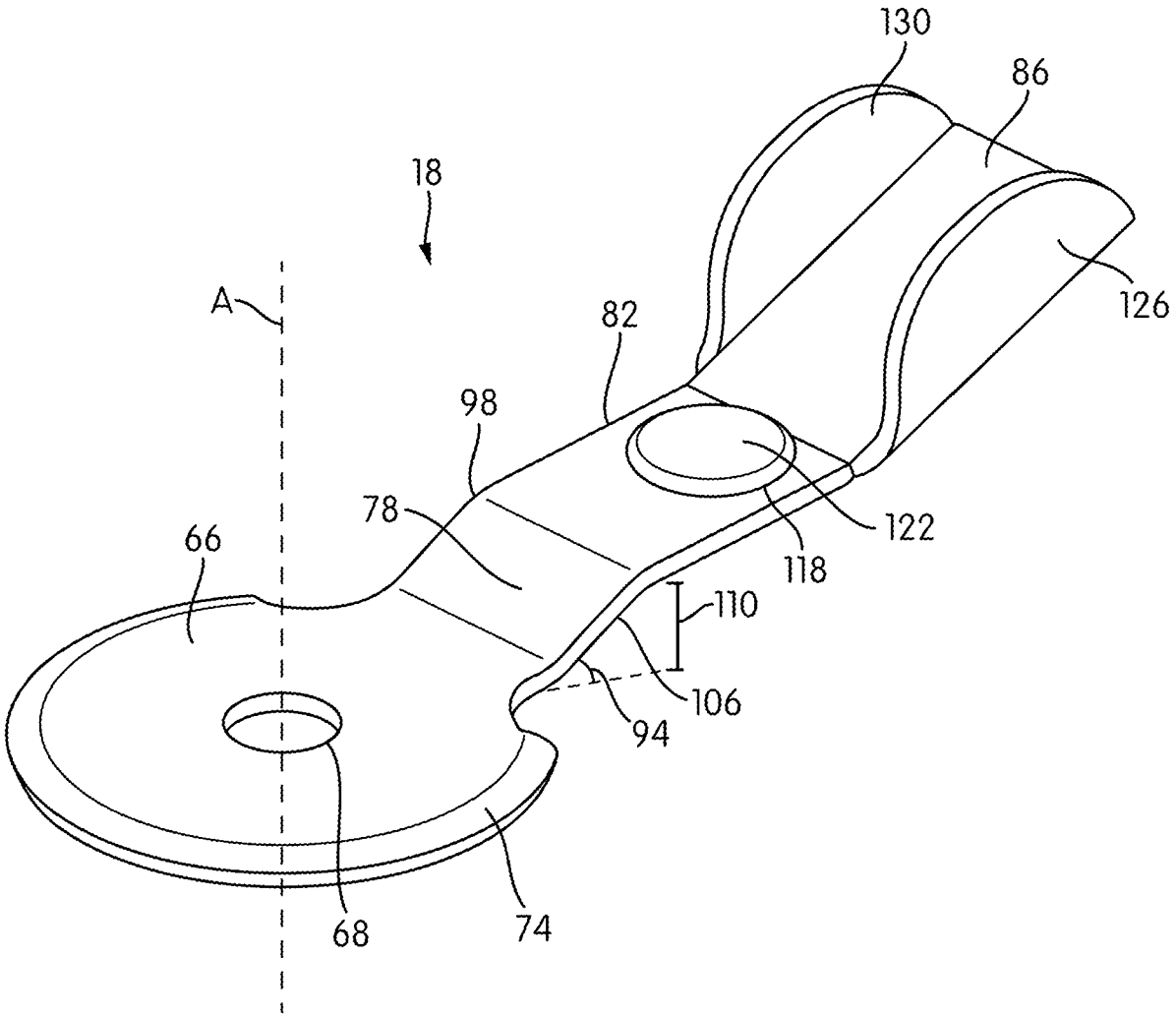
FIG. 2 is a perspective view of the placard fastener of FIG. 1.
Figure 3:
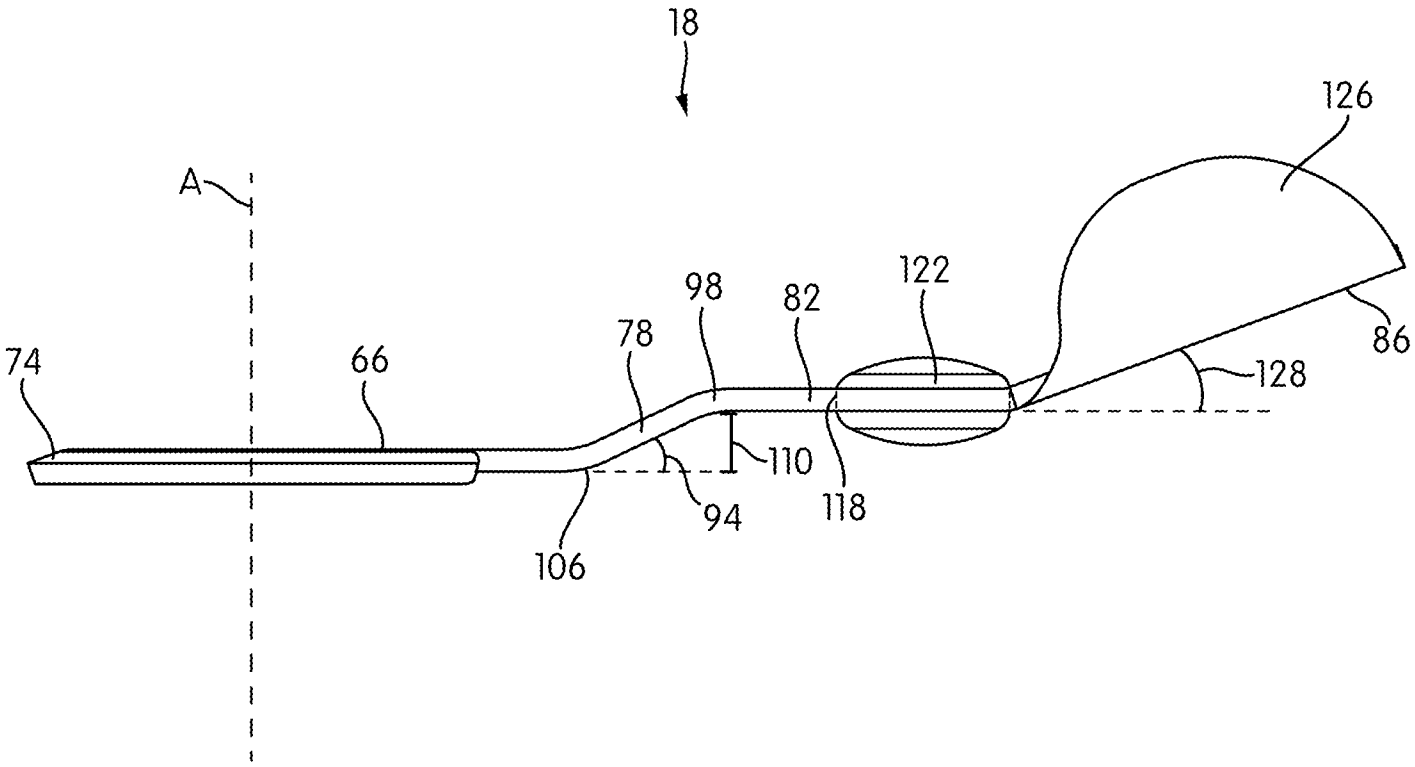
FIG. 3 is a side view of the fastener of FIG. 2.

As shown in FIGS. 2-3, the placard fastener 18 includes a base portion 66, a securing portion 78, an engagement portion 82, and an actuation portion 86. As shown in FIG. 2, the base portion 66 is substantially planar and circular. The base portion 66 includes a mounting hole 68 and a raised angled edge 74. The mounting hole 68 is formed at a center of the base portion 66 and aligned with the longitudinal axis A of the placard fastener 18. The placard fastener 18 is rotatable with respect to the placard holder 14 about an axis A defined by the fastener mounting holes 38 and 68. The fastener mounting hole 68 is sized to receive a fastener 50 (FIG. 1) to secure the placard fastener 18 to the placard holder 14. The fastener 50 may be a screw, a bolt, or any type of fastener that allows rotation therearound. The raised angled edge 74 is formed around a portion of the perimeter of the base portion 66. The raised angled edge 74 prevents the placard fastener 18 from being detached from the placard holder 14 if, for example, an object falls against the base portion 66.

As shown in FIGS. 2-3, the securing portion 78 extends between the base portion 66 and the engagement portion 82. The securing portion 78 is angled with respect to the base portion 66. In the illustrated construction, the securing portion 78 is at an angle 94 (FIG. 3) with respect to the base portion, such angle 94 being in the range of 23-27 degrees, and more specifically 25 degrees. The engagement portion 82 is substantially parallel to the base portion. The angle 94 is dimensioned so that a lower surface 106 of the securing portion engages the ridge 42 of the placard holder 14. The angle 94 and a length of the engagement portion 82 are sized so that a distance 110 between an end 98 of the securing portion 78 and the plane defined by the base portion 66 is substantially the same as a height of the ridge 42.

With continued reference to FIGS. 2-3, the engagement portion 82 extends between the securing portion 78 and the engagement portion 82. The engagement portion 82 includes a rivet receiving hole 118 and a rivet 122. The rivet receiving hole 118 is aligned along the longitudinal axis A and positioned proximate the user actuation portion 86. The rivet 122 is secured within the rivet receiving hole 118. A portion of the rivet 122 extends below the engagement portion 82 and a portion of the rivet 122 extends above the engagement portion 82. The portion of the rivet 122 that extends below the engagement portion 82 engages the placard (not shown) to secure the placard within the placard holder 14. In the illustrated construction, the rivet 122 engages the lip 64 of the second holder portion 26. In alternate constructions, the rivet 122 may engage the placard. The rivet 122 is preferably made from a nylon material to prevent damage to the placard or the placard holder 14 as the rivet 122 slides along the placard frame or the placard holder as the placard fastener 18 is rotated. The angle 102 is dimensioned so that the rivet 122 is in engagement with the placard holder 14 or the placard (not shown) and preloaded so that the rivet 122 exerts a force against the placard holder 14 or the placard (not shown).

As shown in FIGS. 2-3, the actuation portion 86 extends from the engagement portion 82 at an angle 128 (FIG. 3), such angle being in the range of 23-27, and more specifically 25 degrees. The user actuation portion 86 includes a first tab 126 and a second tab 130. The first tab 126 and the second tab 130 are positioned at opposing sides of the user actuation portion 86. In the illustrated construction, the first tab 126 and the second tab 130 are substantially perpendicular to the user actuation portion 86.

The placard holder 14 and the placard fastener 18 are preferably made of stainless steel to provide strength, durability and corrosion resistance.

Figure 4:
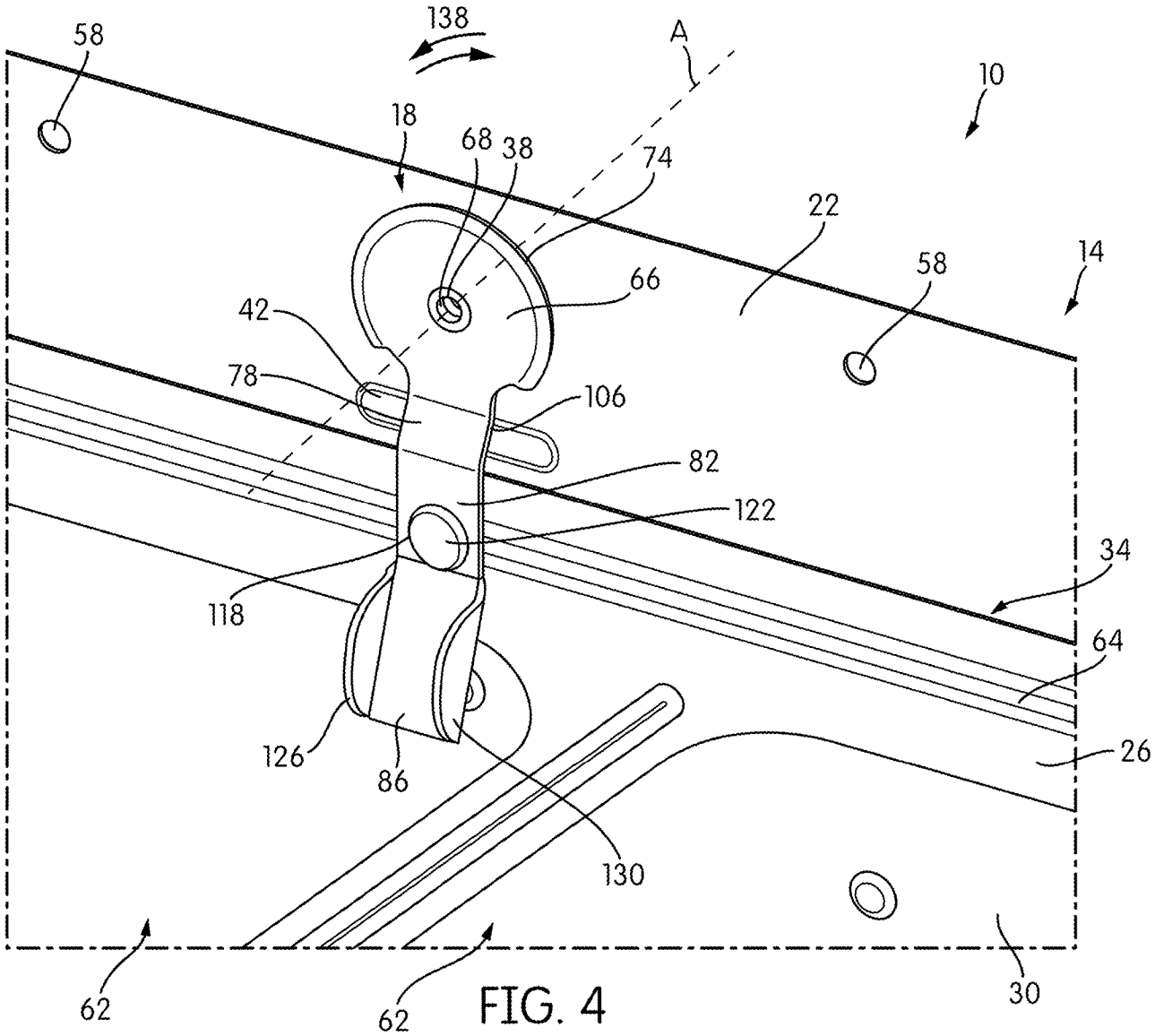
FIG. 4 is a detail view of the placard fastener of the placard holder of FIG. 1 in a securing position.
Figure 5:
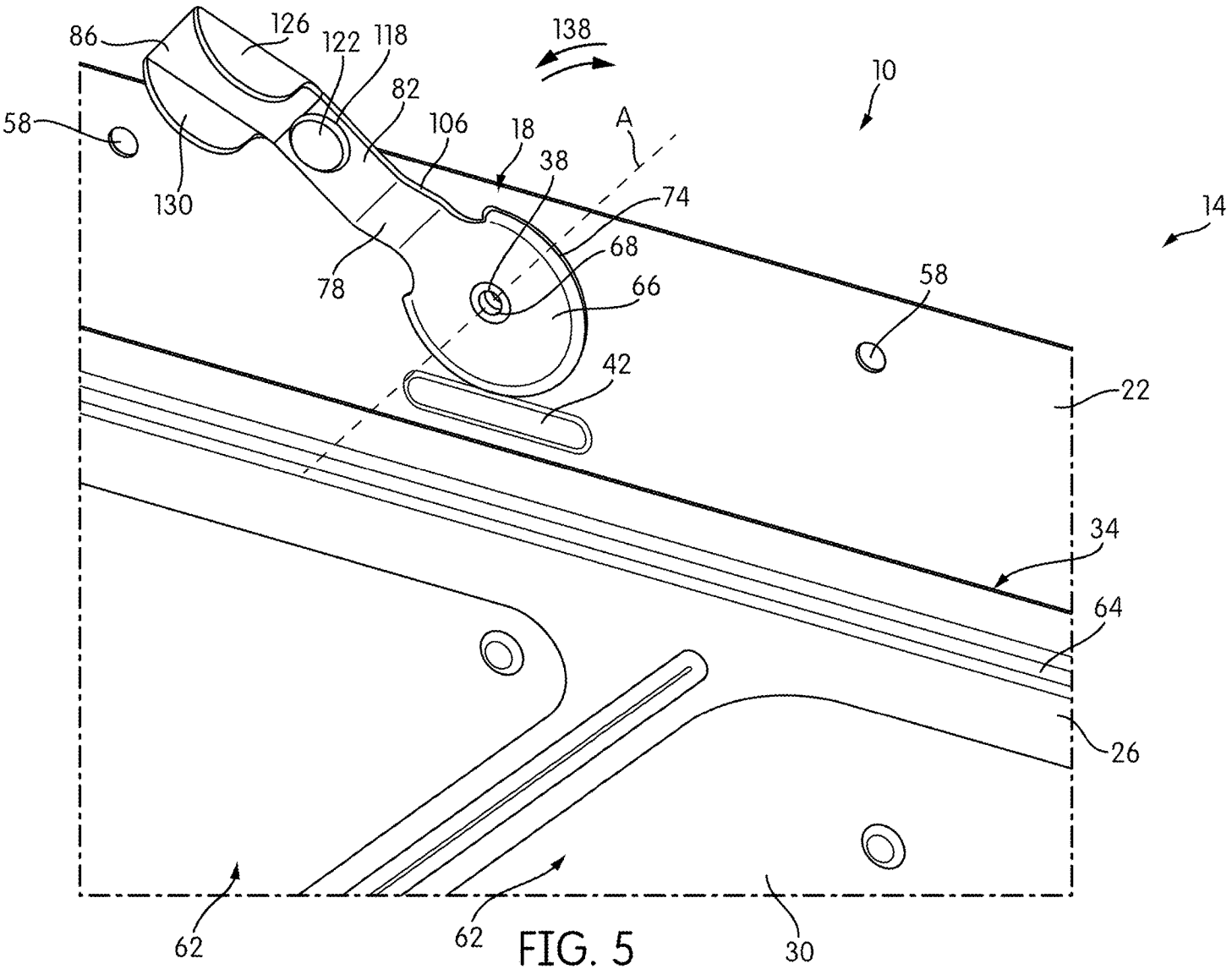
FIG. 5 is a detail view of the placard fastener of the placard holder of FIG. 1 in an open position.

In operation, an operator selects the appropriate placard for a hazardous cargo transported within a shipping container (not shown). The operator grasps the actuation portion 86 and swings the placard fastener 18 about the axis A until it is rotated away from the lip 64 and the opening 34 of the placard holder 14 (FIG. 5). If the placard fastener 18 is engaged with the raised ridge 42, the user exerts a force to overcome a friction fit between the securing portion 78 and the raised ridge 42. The user positions the placard within the cavity 30. The user then swings the placard fastener 18 about the axis A so that the rivet 122 slides over the lip 64 and the placard fastener 18 blocks the opening 34 of the placard holder 14 (FIG. 4). If the placard holder 14 includes a raised ridge 42, the user exerts a force to engage the securing portion against the raised ridge 42. In a preferred construction, the placard fastener 18 is rotatable or swingable about the axis of rotation A in either a clockwise or a counterclockwise direction as shown by the arrows 138 (FIGS. 4-5).

The placard fastener 18 is designed with the end-user in mind. The end-user can quickly and easily insert/remove placards from the placard holder 14 by pivoting or swinging the placard fastener 18 to the left or right to release it from the placard holder 14. Swinging or pivoting the placard fastener 18 left or right reduces the pressure on the placard fastener 18 thereby increasing the useful life of the placard fastener 18 reducing breakage of the component.

Various features and advantages of the disclosure are set forth in the following claims.

What is claimed is:

1. A placard system for a transportation container or vehicle, the placard system including:

a holder including a cavity and a placard fastener mounting hole, the cavity configured to receive a placard, and the placard fastener mounting hole spaced from an opening of the cavity and defining an axis of rotation;

a placard fastener engaged with the holder and rotatable about the axis of rotation between a closed position in which the placard fastener blocks a portion of the opening of the cavity and an open position in which the placard fastener is spaced from the opening of the cavity, the placard fastener including:

a base portion including a mounting hole, a securing portion configured to engage the holder or the placard, the securing portion being oriented at a non-zero angle relative to the base portion, and an actuation portion oriented at a non-zero angle relative to an engagement portion.

2. The placard system of claim 1, wherein the cavity is formed between a first holder portion and a second holder portion, and a raised ridge is formed on the first holder portion and spaced from the opening of the cavity, and wherein the securing portion is positioned between the base portion and the engagement portion, the securing portion adapted to engage the raised ridge.

3. The placard system of claim 2, wherein the securing portion is friction fit against the raised ridge when the placard fastener is in the closed position.

4. The placard system of claim 2, wherein an end of the securing portion is spaced a distance from the first holder portion, and the distance is substantially the same as a height of the raised ridge.

5. The placard system of claim 2, wherein the securing portion is angled approximately 23-27 degrees with respect to the planar base portion.

6. The placard system of claim 2, wherein the actuation portion is angled approximately 23-27 degrees with respect to the engagement portion.

7. A placard system for a transportation container or vehicle, the placard system including:

a holder including a cavity and a placard fastener mounting hole, the cavity configured to receive a placard, and the placard fastener mounting hole spaced from an opening of the cavity and defining an axis of rotation;

a placard fastener engaged with the holder and rotatable about the axis of rotation between a closed position in which the placard fastener blocks a portion of the opening of the cavity and an open position in which the placard fastener is spaced from the opening of the cavity, the placard fastener including:

a base portion including a mounting hole, an engagement portion configured to engage the holder or the placard, and an actuation portion, wherein the engagement portion includes a rivet that engages a lip of the placard holder.

8. The placard system of claim 7, wherein the rivet is a nylon rivet.

9. A placard system for a transportation container or vehicle, the placard system including:

a holder including a cavity and a placard fastener mounting hole, the cavity configured to receive a placard, and the placard fastener mounting hole spaced from an opening of the cavity and defining an axis of rotation;

a placard fastener engaged with the holder and rotatable about the axis of rotation between a closed position in which the placard fastener blocks a portion of the opening of the cavity and an open position in which the placard fastener is spaced from the opening of the cavity, the placard fastener including:

a base portion including a mounting hole, an engagement portion configured to engage the holder or the placard, and an actuation portion, wherein the actuation portion includes a first tab and a second tab.

10. The placard system of claim 1, wherein the placard fastener is made from stainless steel.

11. A method for securing a placard within a placard holder for transportation, the method including:

grasping an actuation portion of a placard fastener, the placard fastener including a base portion having a mounting hole defining an axis of rotation and an engagement portion configured to engage the placard holder, swinging the placard fastener about the axis of rotation so that the placard fastener is spaced from an opening of a cavity of the placard holder;

positioning a placard within the cavity of the placard holder; and swinging the placard fastener about the axis of rotation so that the placard fastener is blocking a portion of the opening of the cavity and so that the actuation portion is orientated above the placard;

frictionally engaging a securing portion of the placard fastener positioned between the base and the engagement portion against a raised ridge formed on the first holder portion and spaced from the opening of the cavity, wherein the securing portion is oriented at a non-zero angle relative to the base portion.

12. The method of claim 11, wherein an end of the securing portion is spaced a distance from the first holder portion, and the distance is substantially the same as a height of the raised ridge.

13. The method of claim 11, wherein the securing portion is angled approximately 23-27 degrees with respect to the base portion.

14. The method of claim 11, wherein the actuation portion is angled approximately 23-27 degrees with respect to the engagement portion.

15. A method for securing a placard within a placard holder for transportation, the method including:

grasping an actuation portion of a placard fastener engaged with the placard holder, the placard fastener including a base portion having a mounting hole defining an axis of rotation and an engagement portion configured to engage a lip of the placard holder, swinging the placard fastener about the axis of rotation so that the placard fastener is spaced from an opening of a cavity of the placard holder;

positioning a placard within the cavity of the placard holder; and swinging the placard fastener about the axis of rotation so that the placard fastener is blocking a portion of the opening of the cavity, wherein the engagement portion includes a rivet.

16. A method for securing a placard within a placard holder for transportation, the method including:

grasping an actuation portion of a placard fastener engaged with the placard holder, the placard fastener including a base portion having a mounting hole defining an axis of rotation and an engagement portion configured to engage a lip of the placard holder, swinging the placard fastener about the axis of rotation so that the placard fastener is spaced from an opening of a cavity of the placard holder;

positioning a placard within the cavity of the placard holder; and swinging the placard fastener about the axis of rotation so that the placard fastener is blocking a portion of the opening of the cavity, wherein the actuation portion includes a first tab and a second tab.

17. A placard system for a transportation container for use with a transportation vehicle, the placard system including:

a holder including a cavity and a raised ridge, the cavity configured to receive a placard, the cavity formed between a first holder portion and a second holder portion, and the raised ridge formed on the first holder portion and spaced from an opening of the cavity, a placard fastener mounting hole spaced from an opening of the cavity and defining an axis of rotation;

a placard fastener engaged with the holder and rotatable about the axis of rotation between a closed position in which the placard fastener is engaged with the raised ridge and blocks a portion of the opening of the cavity, and an open position in which the placard fastener is spaced from the opening of the cavity, the placard fastener including:

a base portion having a mounting hole, an engagement portion including a vinyl rivet that engages the placard or the placard holder configured to engage the holder or the placard, a securing portion positioned between the planar base and the engagement portion, the securing portion adapted to engage the raised ridge, and an actuation portion.

18. The placard system of claim 17, wherein an end of the securing portion is spaced a distance from the first holder portion, and the distance is substantially the same as a height of the raised ridge.

19. The placard system of claim 17, wherein the securing portion is at an angle of approximately 23-27 degrees from the base portion.

* * * * *